US006042437A

United States Patent [19]

Widmann et al.

[11] Patent Number: 6,042,437

[45] Date of Patent: Mar. 28, 2000

[54] EXHAUST KNOCK DOWN SPRAY

[75] Inventors: Alexander Widmann; George F. Widmann, both of Palm Harbor, Fla.

[73] Assignee: Eco Sound Inc, Tarpon Springs, Fla.

[21] Appl. No.: 09/227,444

[22] Filed: Jan. 8, 1999

[51] Int. Cl.[7] ..... B63H 21/32

[52] U.S. Cl. ..... 440/89; 181/238

[58] Field of Search ..... 440/88, 89; 181/235, 181/238

[56] References Cited

U.S. PATENT DOCUMENTS

| | | | |
|---|---|---|---|
| 4,002,136 | 1/1977 | Michalak | 440/89 |
| 4,744,778 | 5/1988 | Porter | 440/89 |
| 4,977,977 | 12/1990 | Von Widmann et al. | 440/89 |
| 5,094,640 | 3/1992 | Burdick et al. | 440/89 |
| 5,719,358 | 2/1998 | Lindholm | 440/89 |
| 5,846,107 | 12/1998 | Widmann | 440/89 |

*Primary Examiner*—Jesus D. Sotelo
*Attorney, Agent, or Firm*—Harold D. Shall

[57] ABSTRACT

An exhaust knockdown spray includes a scoop on the underside of a boat hull which picks up water when the boat is underway, and, through a conduit, directs the water to a spray nozzle at the rear of the hull where the water falls upon any exhaust coming out of the hull. The scoop is positioned ahead of the rudder blade so that the rudder has a steering effect after the steering effect of the scoop.

3 Claims, 4 Drawing Sheets

EXHAUST KNOCK DOWN SPRAY

BACKGROUND OF THE INVENTION

1. Field of the Invention

This invention relates to the treatment of exhaust gases from a marine engine installed in a vessel and more particularly to substantially reducing air borne gases when the vessel is underway.

2. Description of the Prior Art

A device that scoops up water as a boat is being propelled through the water, and deposit such water on the exhaust of a marine engine to thereby drive such gases together with any particles therein down and onto the water supporting the boat hull are known. Such a device is shown in U.S. Pat. No. 2,766,714 which does not show or discuss the usual propeller and rudder of the vessel. It is well known that devices protruding from the hull of a vessel into the water have a steering affect upon the vessel as it moves through the water. Such will be the case with the device of U.S. Pat. No. 2,766,714, since the intake 20 of his device is at the very stern of the vessel and from the details thereof is intended to be secured to the aft end of the transom of a vessel. Thus the intake 20 must be behind the conventional rudder and have a steering effect, most likely an effect to keep the vessel going straight even though the rudder ahead of it may be calling for a turn. Since the pick up is behind the rudder, it can redirect the steering of the rudder.

However, in applicant's device the rudder blade is behind the pick up and thereby the rudder is controlling in steering the vessel.

SUMMARY OF THE INVENTION

It is an object of this invention to provide an exhaust knock down spray wherein the water pickup for the spray is positioned forward of the rudder blade.

It is another object of this invention to provide such a pickup in a location aft of the propeller.

In one embodiment, an exhaust chamber is disposed at the rear of the boat (such a chamber is seen in my co-pending applications Ser. No. 08/880,143 filed Jun. 6, 1997 and Ser. No. 09/045,689 filed Mar. 23, 1998 wherein the vessel's exhaust, when on plane, is discharged through an opening in the bottom of the boat hull which buries the exhaust thereby both quieting the exhaust and embedding the exhaust gases and particles in the water. However, some of this exhaust does emerge from the water and it is desirable to reduce this to the fullest extent possible. To that end I have invented a known down spray which is directed upon the exhaust to knock it down into the water. The source of the water for the spray is on the underside of the hull and is a scoop confluently connected to the sprayer. This scoop is located so not to be to the rear of the boat's rudder blade. Applicant has found a satisfactory location is along side the rudder post so that the rudder blade which extends rearwardly from the post will be behind the scoop. Thus, as the boat moves through the water, the scoop picks up water and the velocity thereof forces it up the scoop and out the spray wherein it is directed onto the exhaust.

Another shown embodiment does not have an exhaust chamber and the exhaust gasses are directly discharged from the exhaust pipe at the rear of the boat, with the spray directed downwardly thereon. Again, as in the previous embodiment, the scoop is positioned so as not to be to the rear of the boat's rudder blade. Since the boats propeller is normally directly in front of the rudder, in not positioning the scoop behind the rudder, it is positioned alongside the post thereof. However, if sufficient room is present it can be positioned between the propeller and the rudder.

DETAILED DESCRIPTION OF THE PREFERRED EMBODIMENT

Figure 1:
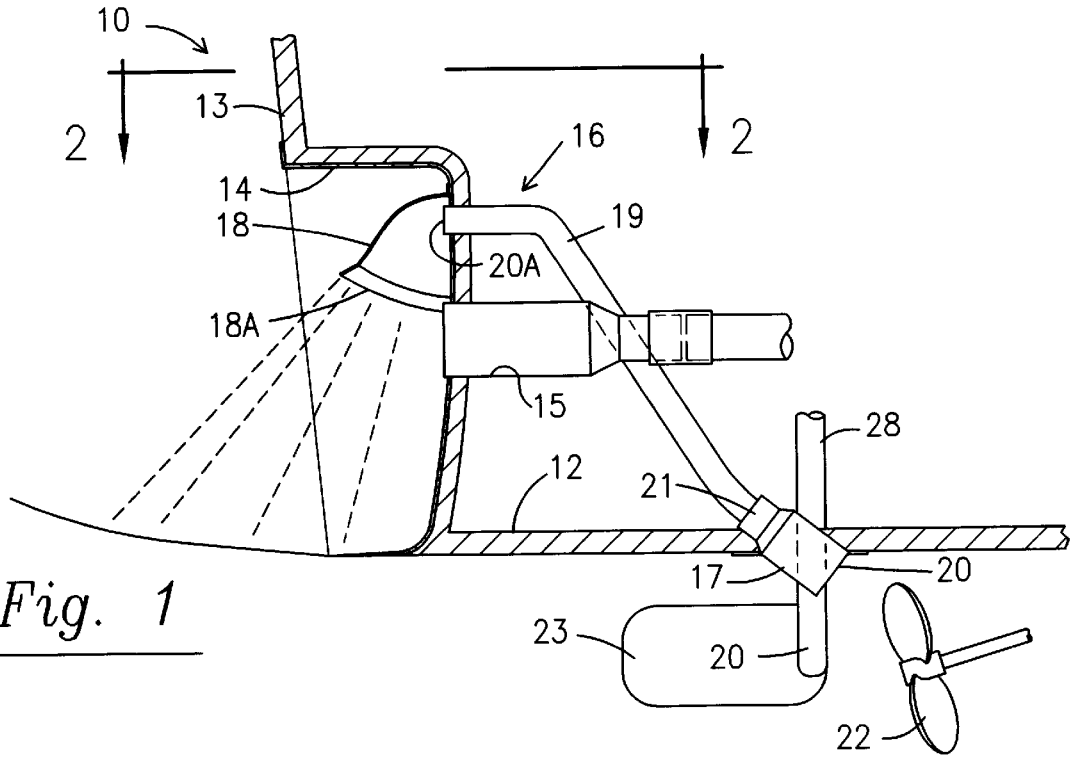
FIG. 1 is a longitudinal section view of the a rear portion of a boat hull having an Exhaust Knockdown Spray according to this invention installed.
Figure 2:
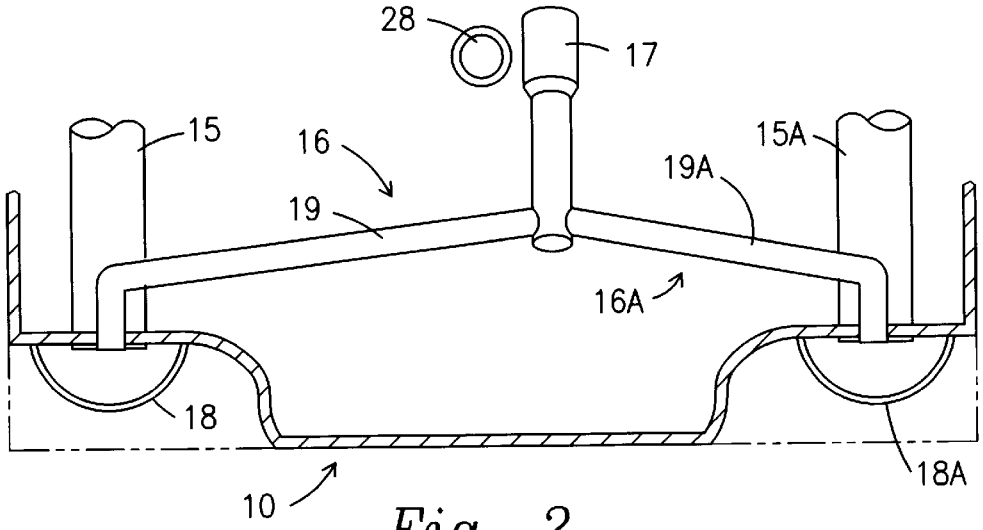
FIG. 2 is a view taken along lines 2—2 in FIG. 1.

Referring now to the drawings and more particularly FIGS. 1, and 2, a boat hull is shown fragmentarily at 10 and includes the bottom of the hull shown at 12, a transom 13, having a relieved portion 14, and conventional gas engine exhaust pipe 15 leading from the engine (not shown), and which pipe 15 extends out of the relieved portion 14 of the transom. An exhaust knockdown spray system is shown generally at 16 and includes a scoop 17, a discharge nozzle housing 18, and a connecting conduit 19. The scoop 17 is cylindrical and hollow and commences at its open end 20 which protrudes forwardly from the bottom of the hull 12, thence rearwardly and upwardly and sealingly through the hull 12 to be sealingly secured to the conduit 19 and the latter extends to and opens into the nozzle housing 18 which has downwardly directed open end 18A. As the boat moves forwardly through the water, water entered the scoop 17 and is forced upwardly through the conduit 19 and out through the open end of the conduit within the housing 18. The housing 18 is enclosed on its top and back side while being open on its bottom side so that the water from the housing 18 is discharged downwardly on to the exhaust being discharged from the exhaust pipe 15. The housing 18 having half of a bell shape, so that discharged water not only goes downwardly but also slightly rearward and laterally to ensure adequate exhaust coverage.

A typical size relationship which has been found satisfactory is an open end 20 of the scoop 17 having a diameter of 100 mm, a reduced portion 21 having a diameter of 63.2 mm the open end 20A having a diameter of 63.2 mm, the nozzle housing 18 having a external vertical height of 125 mm, an internal horizontal width at the bottom thereof of 150 mm and an internal horizontal depth at the bottom thereof of 100 mm. Since the opening 20 is much larger than the reduced portion 21, the velocity of the water entering the scoop 17 is substantial increased thereby and a strong flow of water is discharged from the opening 18A of the housing 18.

The boat is propelled through the water by a propeller 22, aft of which is conventionally positioned a conventional rudder blade 23 mounted on a rudder post 28 extending vertically through the hull 12 to steer the boat in a conventional manner; the portion of the rudder blade 23 being the steering effective portion of the rudder. The steering effect the scoop 17 may impose on the hull 12 by the water flowing therepast will be overcome by the steering effect of the rudder blade 23.

FIG. 2 shows the installation of the system as viewed from above on a boat hull with dual exhausts 15 and 15A and dual knockdown systems 16 and 16A having nozzle housings 18 and 18A respectfully. A single scoop 17 is shown providing water to both of the housings 18 and 18A; however, a separate scoop and a conduit can be provided for both housings, with the scoops on opposed sides of the rudder post for neutral steerage effect thereby.

Figure 3:
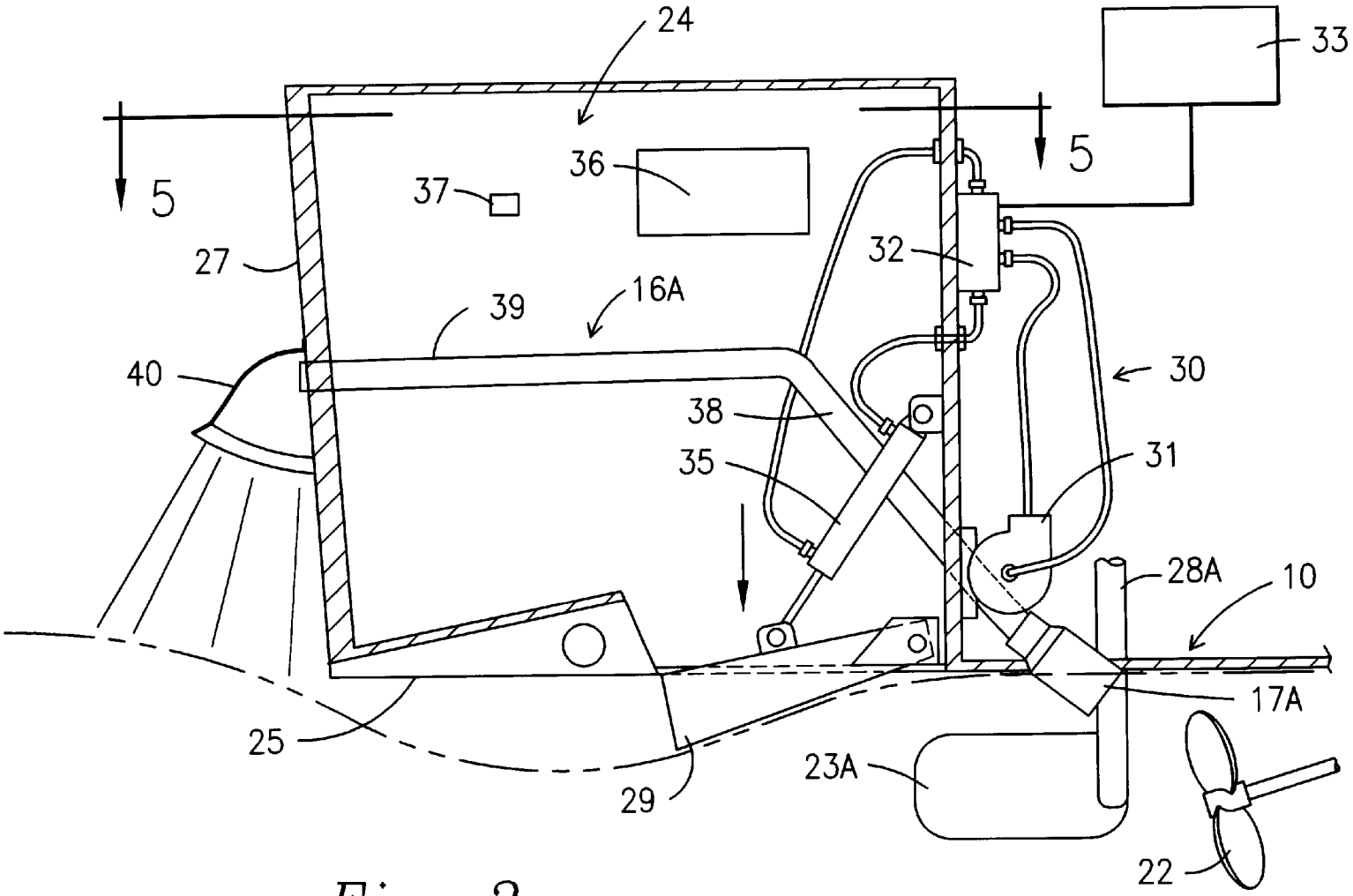
FIG. 3 taken along lines 3—3 in FIG. 4, is a view like FIG. 1 of another embodiment of this invention.
Figure 4:
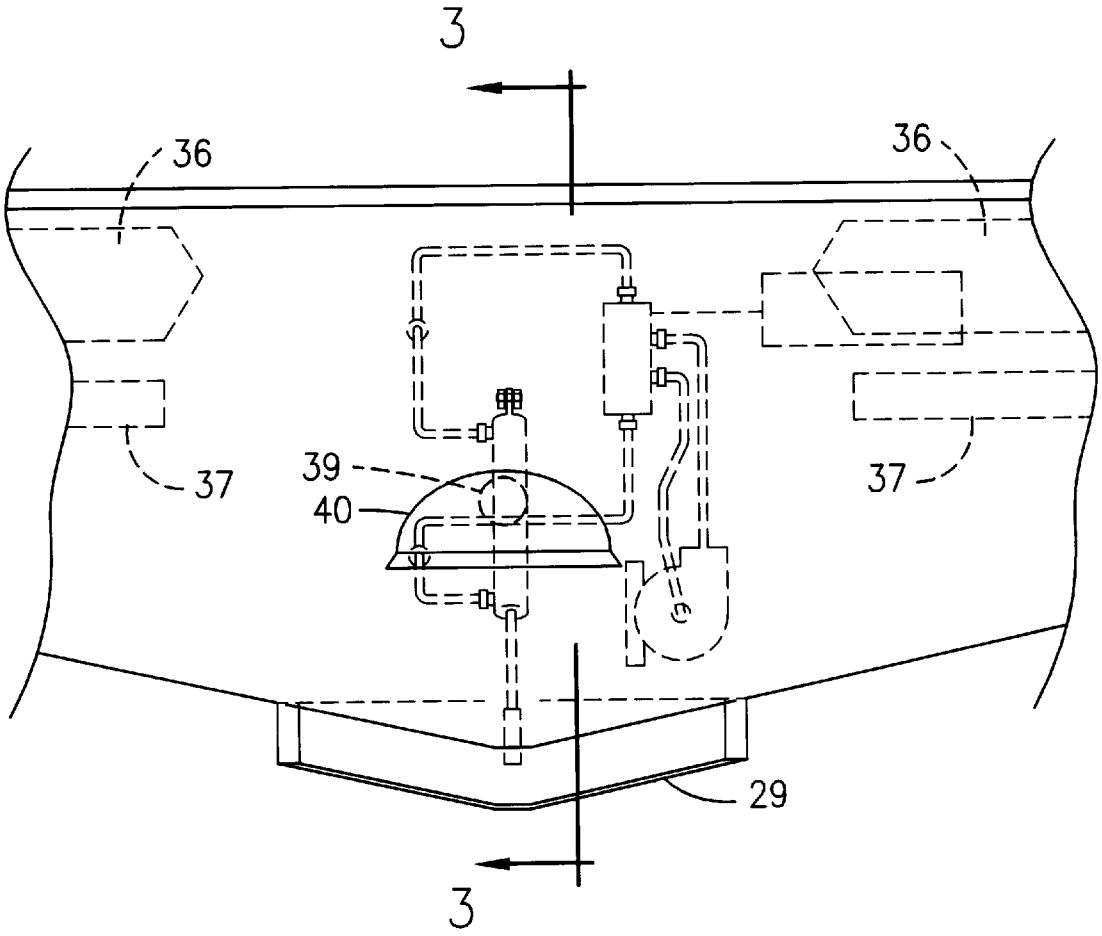
FIG. 4 is a rear view of a boat hull having the embodiment of FIG. 3 therein.
Figure 5:
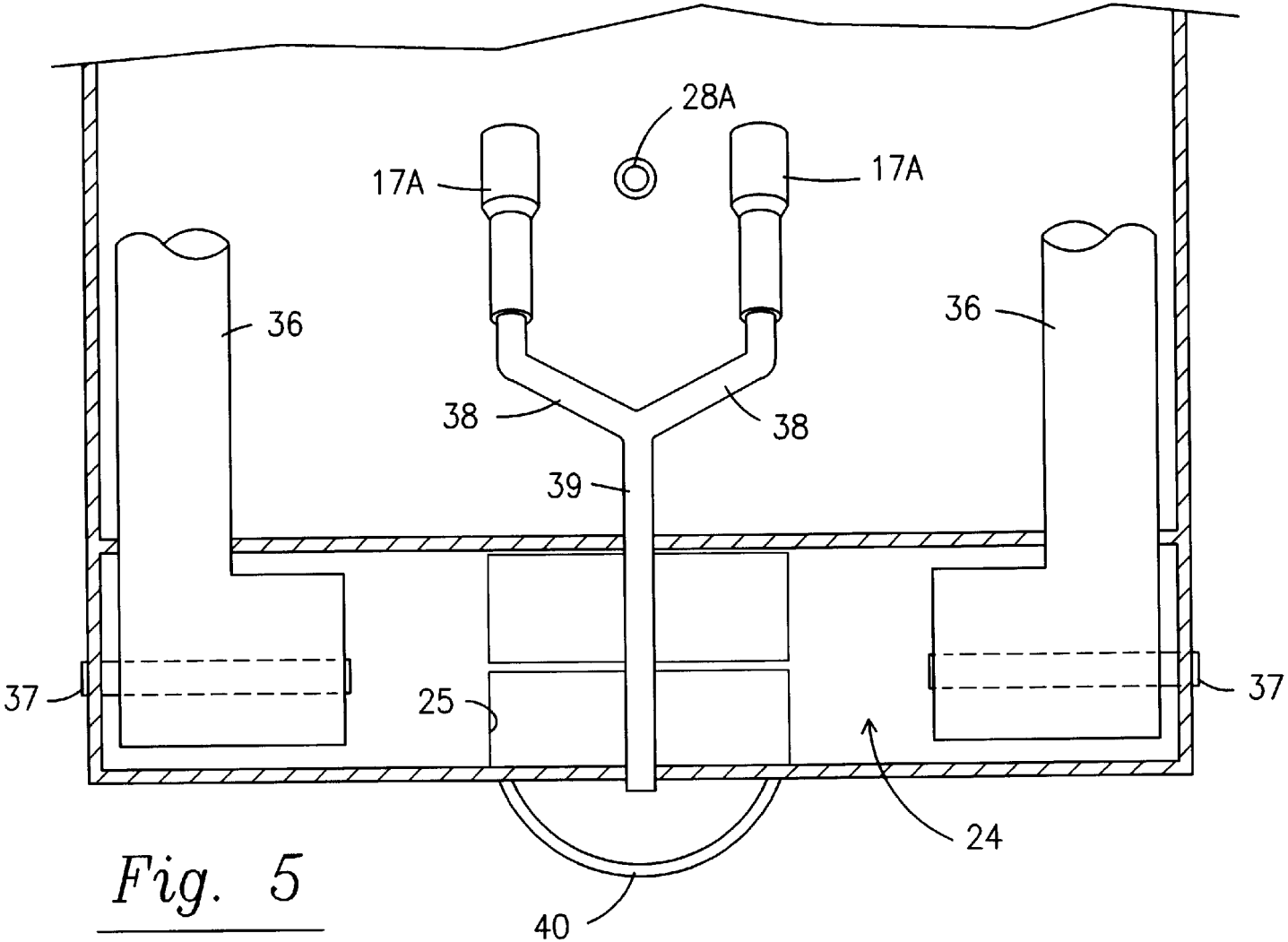
FIG. 5 is a schematic plan view of the embodiment of FIG. 4.

While FIGS. 1 and 2 show the systems 16 installed on a hull with an exhaust symbolizing gasoline engine, such a system will also work on a diesel engine. While a diesel engine can be installed as seen in FIGS. 1 and 2, to more effectively reduce exhaust emissions from a diesel engine an exhaust chamber 24 can be utilized as seen in FIGS. 3 through 5 and more fully described in my co-pending application referred to above.

The exhaust chamber 24 has a forward wall 26 and a rearward wall 27, it being understood that the forward wall 26 may be the transom of the vessel with the wall 27 being an added rear wall behind the transom, or that the wall 27 can be the transom and the wall 26 be a wall forward of the transom. The wall 27 is therefore, the rear wall of the vessel. An opening 25 in the rear central and lower portion of the hull 10 provides a high speed exhaust opening, while an adjustable wedge 29 pivotly mounted on the hull at the forward end of the opening 25 can be pivoted by an actuating system 30, including a pump 31, a control valve 32, and a controllable device 33 for actuating the valve 32 and a hydraulic cylinder 35 connected and actuated by the value 32 to raise or lower the rearward end of the wedge 29 to thereby adjust the vacuum in the chamber 24 as described in my co-pending application previously referred to.

The chamber 24 has a pair of exhaust manifolds 36, which connect the engines (not shown) in the hull 20 to the exhaust chamber 24, leading thereinto, so that the exhaust enters the chamber 24. A pair of low speed exhausts, above the water line of the hull, discharge the engine's exhaust at low speed. When the vessel comes on plane, the exhaust is discharged from the Chamber 24 through the opening 25 at the rear of the hull 10.

A knock down system 16A has a pair of scoops 17A. One on each lateral side of the rudder post 28A so that the rudder 23A is behind the scoops 17A and has the final steering control of the vessel. A pair of conduits 38 connect the pair of scoops 17A to a common conduit 39 which, in turn, leads through the rear wall 27 and discharges within the nozzle housing 40 in a manner as described re the embodiment of FIGS. 1 and 2. Water from the housing 40 is directed downwardly and strikes any exhaust which may be moving out of the opening 25, to thereby knock such errant exhaust back down into the water.

While certain embodiments of this invention have been shown and described, it is apparent that many changes can be made therein without departing from the scope of this invention as shown and described.

What is claimed is:

1. A boat hull having an exhaust system and a propeller near the aft end thereof and a rudder blade aft of the propeller with a rudder post at the forward end of the blade and an a inlet scoop on the hull bottom for a knock down exhaust system which has a discharge housing at the rear of the hull connected by conduit means to such scoop, and with the discharge from the scoop being directed onto the exhaust from the hulls exhaust system characterized in that said scoop is disposed forwardly of said rudder blade and aft of said propeller whereby said rudder blade provides the effective steering control on the hull over said scoop.

2. A hull according to claim 1 further characterized in that said scoop is positioned in lateral alignment with said rudder post and forward of said rudder blade.

3. A hull according to claim 1 wherein said hull has an exhaust chamber at the aft end thereof with such chamber having an opening through the bottom of the hull at the rear end thereof further characterized in said exhaust from said exhaust system is directed below the water line of the hull and the discharge from the scoop is directed onto any exhaust from the said exhaust system which may come out of the water behind the hull.

* * * * *